US010307312B2

(12) United States Patent
Butterfield et al.

(10) Patent No.: US 10,307,312 B2
(45) Date of Patent: Jun. 4, 2019

(54) GURNEY PROTECTIVE COVER

(71) Applicants: Matthew Butterfield, Kayville, UT (US); Ronald Lay, Salt Lake City, UT (US)

(72) Inventors: Matthew Butterfield, Kayville, UT (US); Ronald Lay, Salt Lake City, UT (US)

( * ) Notice: Subject to any disclaimer, the term of this patent is extended or adjusted under 35 U.S.C. 154(b) by 318 days.

(21) Appl. No.: 14/998,202

(22) Filed: Dec. 23, 2015

(65) Prior Publication Data

US 2016/0220428 A1 Aug. 4, 2016

Related U.S. Application Data

(60) Provisional application No. 62/096,532, filed on Dec. 23, 2014.

(51) Int. Cl.

| | |
|---|---|
| ***A47G 9/00*** | (2006.01) |
| ***A61G 1/01*** | (2006.01) |
| ***A47C 27/00*** | (2006.01) |
| ***A61G 1/04*** | (2006.01) |
| ***A47C 29/00*** | (2006.01) |
| ***A47C 17/82*** | (2006.01) |
| ***A47C 31/00*** | (2006.01) |
| ***A47C 20/02*** | (2006.01) |
| ***A47G 9/06*** | (2006.01) |
| ***A47C 27/14*** | (2006.01) |
| ***A61G 1/048*** | (2006.01) |
| ***A47G 9/02*** | (2006.01) |
| *A61G 1/044* | (2006.01) |

(52) U.S. Cl.

CPC ..... *A61G 1/04* (2013.01); *A47G 9/0246* (2013.01); *A61G 1/01* (2013.01); *A61G 1/048* (2013.01); *A47C 17/82* (2013.01); *A47C 29/00* (2013.01); *A47G 9/06* (2013.01); *A61G 1/044* (2013.01)

(58) Field of Classification Search

CPC ... A61G 1/01; A61G 1/04; A61G 1/06; A47G 9/00; A47G 9/06; A47C 27/00; A47C 29/00; A47C 17/82; A47C 31/00; A47C 20/02; A47C 27/14

See application file for complete search history.

(56) References Cited

U.S. PATENT DOCUMENTS 3,638,251 A 2/1972 Weiss
3,775,784 A * 12/1973 Fry ..... A61G 1/003 5/81.1 C
4,634,618 A * 1/1987 Greer ..... A47G 9/062 383/127
4,693,691 A * 9/1987 DeYoe ..... B63C 9/30 441/129
4,939,803 A * 7/1990 Waters ..... A47C 7/66 5/113
4,993,092 A * 2/1991 Weeks ..... A61G 1/01 150/154
5,099,530 A * 3/1992 Scott ..... A47G 9/02 5/419
5,199,120 A * 4/1993 Holmes ..... A45F 4/06 190/2
5,575,025 A * 11/1996 Peters ..... A47C 27/005 5/482
5,615,425 A 4/1997 Corente
5,642,543 A * 7/1997 Huntley ..... A47G 9/10 5/490
5,785,219 A * 7/1998 Kraft ..... A45F 4/02 2/66
6,014,935 A * 1/2000 Willett ..... A47G 11/004 108/50.11
6,105,188 A * 8/2000 Perez-Mesa ..... A45C 9/00 383/4
6,182,309 B1 * 2/2001 Sullivan ..... A45C 3/10 5/419
6,453,492 B1 9/2002 Sturrock
6,742,635 B2 * 6/2004 Hirshberg ..... A45C 9/00 190/2
7,131,156 B1 * 11/2006 Walker-Craft ..... A47G 9/1045 5/639
7,222,705 B1 * 5/2007 Guza ..... A45C 15/00 190/1
7,614,105 B1 * 11/2009 Jackson ..... A47C 7/383 5/640
2005/0028277 A1 2/2005 Gordon
2008/0210245 A1 * 9/2008 Ricketts ..... A61B 46/00 128/849
2010/0154122 A1 * 6/2010 Crispino ..... A47C 21/028 5/636
2010/0186165 A1 * 7/2010 Marciano ..... A47C 17/64 5/419
2011/0030140 A1 * 2/2011 Ruiz ..... A45F 4/06 5/419
2015/0216745 A1 * 8/2015 Christmas ..... A61G 1/01 128/870
2016/0120713 A1 * 5/2016 Magbee ..... A61G 1/01 5/494

* cited by examiner

*Primary Examiner* — Nicholas F Polito
*Assistant Examiner* — Rahib T Zaman
(74) *Attorney, Agent, or Firm* — James Sonntag; Amy Fiene

(57) ABSTRACT

A gurney cover that can be quickly deployed from an integrated pocket to protect a mattress or patient area of a gurney with the undployed gurney cover contained within the integral pocket.

17 Claims, 5 Drawing Sheets

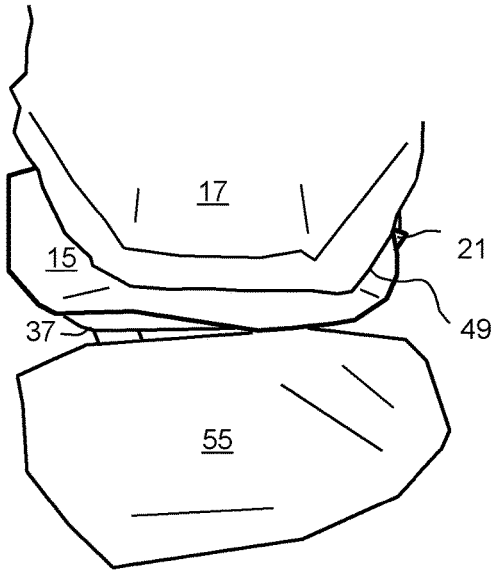
FIG. 2
FIG. 3A
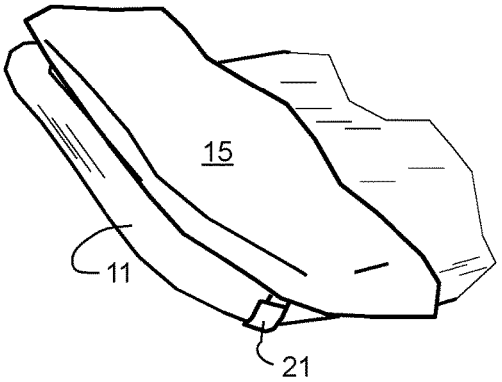
FIG. 3B
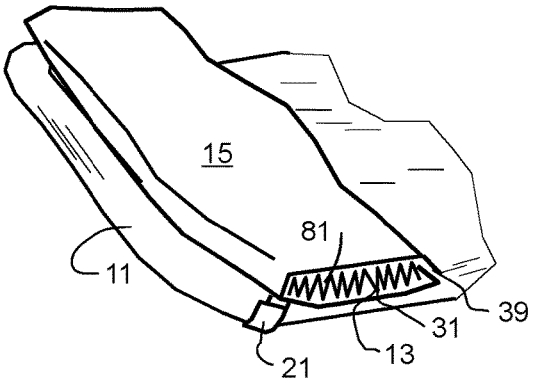

FIG. 8
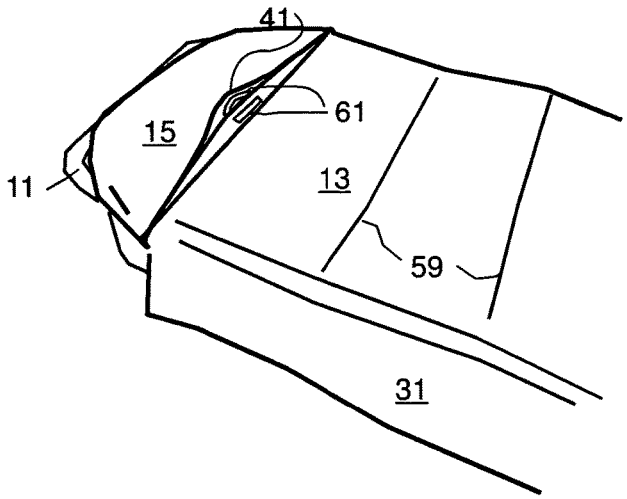
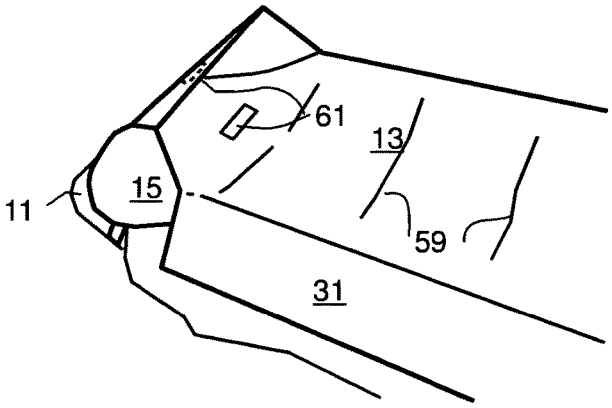
FIG. 9

GURNEY PROTECTIVE COVER

CROSS REFERENCE TO RELATED APPLICATIONS

Priority is claimed from U.S. Provisional Patent Application 62/096,532, filed Dec. 23, 2014, which is hereby incorporated by reference.

BACKGROUND

The gurney is an important tool in illnesses, emergencies, accidents, and crime scenes where possible human occurs by providing a way for moving and evacuating persons and medical patients. In its most basic form, it comprises a generally flat surface upon which a person can be laid, usually covered with bedding, which can include a mattress, some sort of cushion, sheets, blankets and the like.

In addition, an ambulance gurney usually has handles for moving the gurney, straps, tie-down points for oxygen bottles and medical equipment, and an under carriage with wheels that is often collapsible to allow movement of the gurney into an ambulance.

Frequently, a gurney must be used in harsh conditions. For example, a gurney must be in place a ready while a person is evacuated or prepared, which may require that it sit for minutes outdoors in the rain or snow. In these conditions, the mattress will necessarily be wet when the patient is transported. In addition, a gurney may have to be used as a temporary platform for storing equipment or medical personal. Basically, several things can happen to dirty or wet the bedding, which leads to further discomfort to a patient that is already traumatized.

An important consideration in the design of a gurney and any accessory is that it does not materially interfere with the function of the gurney and that its operation by personal be quick and simple.

SUMMARY

Described is a compact, easily and quickly deployed water resistive gurney cover for protecting the bedding of a gurney, particularly for ambulance use, from inclement weather and dirt. It is designed so that it can further be used to optionally cover a patient or equipment that is on the patient area. It can be easily and quickly deployed, and after use it can be reused and quickly made ready to for redeployment. Additionally, the gurney cover is washable and attaches discretely to the gurney with no tools and no alterations to the gurney.

The gurney cover can be made of and suitable fabric material, such as a medium to heavy duty, washable, water repellant fabric. It can be manufactured by any suitable method, such as by sewing, adhesives, or welding of the fabric. Attachment to the gurney can be by any suitable system, such as one or a combination of straps or cords secured by loop and hook (e.g., Velcro™) attachments, and buckles. As shown in the example, loop and hook attachments have been found suitable because they form a secure attachment and their simplicity of operation. Any suitable system for securing fabric, and cover to the gurney is contemplated.

The gurney cover is designed with an integral pocket which attaches to the gurney, and from which it is deployed by simply grasping a handle and pulling it towards the head. The head-end is then secured over the mattress via the sewn in elastic. The handle is preferably a web handle from a web strap, but can be any other suitable form, such as a cord or a gripping aperture in the gurney cover.

To return the gurney cover to the ready, the elastic corners are pulled free of the head of the gurney, and the side panels are folded on top. Standing at the foot of the gurney, the gurney cover is folded, using for example, accordion-style with around 6 inch folds, and returned to the integral pocket. Opposing pair of loop and hook strips, or other suitable attachment, keeps the pocket closed. If desired, the foot part of the mattress can be lifted up slightly and the gurney cover allowed to drop beneath it.

The gurney cover is used to protect the sleeping surface or mattress of the gurney from water and dirt. Immediately before use for transport of the patient, the gurney cover can be quickly removed. With the gurney cover deployed the gurney can be used in the event of necessity provide a work surface, temporary storage of equipment, a sitting or foot rest for personnel, The gurney cover can also be deployed over something upon the mattress, to, for example, to protect equipment. The gurney cover can also be deployed over a patient on the gurney, except the head end of the cover is not attached so that the patient's head is not covered.

BRIEF DESCRIPTION OF DRAWINGS

FIG. 2 shows an example of an undeployed gurney cover in its integral pocket at the foot end of a gurney disposed under the foot of a gurney mattress, and ready to be deployed.

FIG. 3A and FIG. 3B show an example of an undeployed gurney cover in its integral pocket attached at the foot end of a with the gurney mattress removed for clarity.

FIG. 8 shows a deployed gurney cover showing the integral pocket and the loop and hook strips used to keep the opening closed when the gurney cover is in the pocket.

FIG. 9 shows the integral pocket open for clarity, showing the loop and hook strips.

DETAILED DESCRIPTION

Example I

Figure 1:
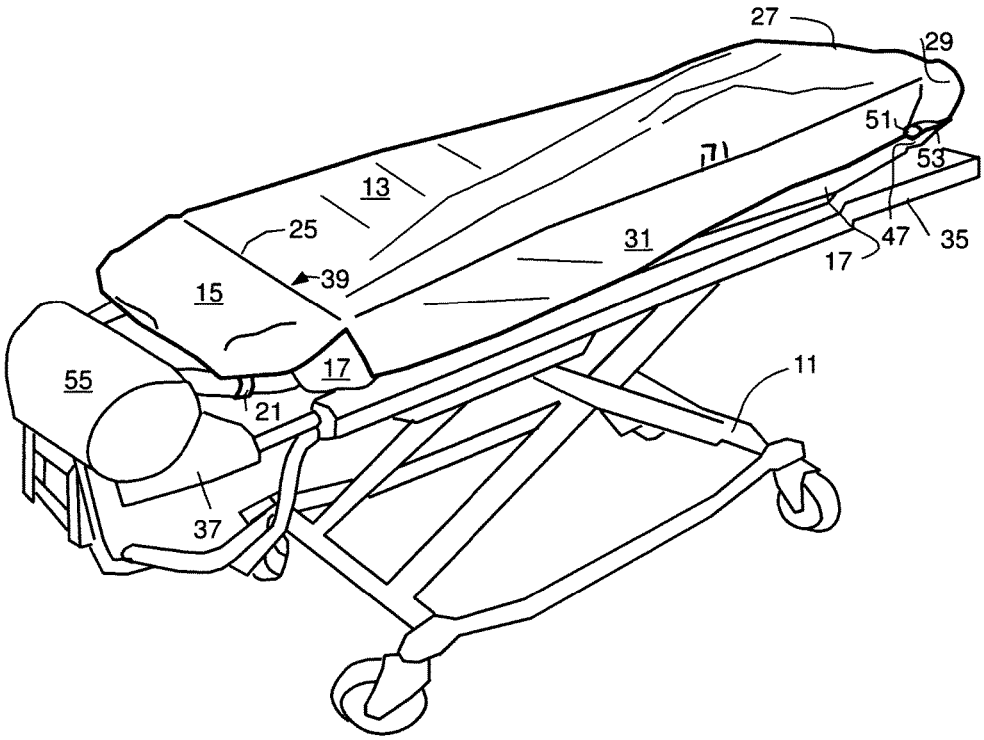
FIG. 1 shows an example of gurney cover deployed over the patient area of a gurney.

Referring to FIG. 1, which shows a gurney cover 13 deployed on a gurney 11. The gurney 11 comprises a generally flat platform surface 45 upon which a patient can lay covered with bedding 17. Attached to the gurney cover is an integral pocket 15, which is designed to contain an undeployed cover.

The integral pocket 15 is attached to the gurney by attachments 21 at or near the first or foot end 47 of the gurney. Bedding or mattress 17 on the generally flat surface of the gurney defines patient area where a patient is laid and rests.

The gurney cover 13 is attached to the integral pocket 15 at an attached end 25 and extends from an opening 39 in the integral pocket 15. The cover 13 is long enough to extend from the attached end 25 to and be attached to top-head or second end 49 of the mattress 17. Attachment of the free end 27 of the cover to the mattress is by fitted corners 29 that can be made by an elastic sewn 51 into the edge of cover 53 and extending around end corners of the mattress at the second end 49 of the mattress 17 (similar to construction as used in a fitted sheet). The fitted corners provide an attachment of the free end 27 of the cover 13 to the mattress that can easily be quickly pulled over and secured and then rapidly removed with a pulling motion without manipulation of buckles, ties and the like. Alternate constructions are contemplated that provide quick secure attachment and rapid removal, such as one or a combination of a pockets or straps, with attachments by loop and hook strips, snaps, or other suitable system.

Referring also to FIG. 2, which is a detail of the foot end 37 of the gurney. When undeployed, the cover is folded into the integral pocket 15, which can be placed under the foot or first end 47 of the mattress 17. This position is clear of other parts or the gurney, such as the oxygen bottle 55, and is easily and quickly reached by lifting the end of the mattress and putting the integral pocket over the mattress where the cover can be deployed over the mattress.

Referring also to FIG. 3A, which is a detail of the foot end 37 of the gurney, as in FIG. 2, but with the mattress removed for clarity. The integral pocket 15 contains the undeployed cover and is attached to the gurney 11 by attachments 21, as illustrated here, at corners or ends of the integral pocket. Most gurneys have a tubular or like element at the edges of a flat surface, and the attachments 21 are suitably a strap around a gurney tube and secured by loop and hook strips as shown. This allows the attachment to be secure, while being easily and quickly removable. Such a removable attachment is required if quick removal of the gurney cover is necessary. Other attachments are suitable, and the attachments 21 can be altered to conform to a different gurney construction or be at any suitable location on the integral pocket 15. Referring to FIG. 3B, which is the same as 3A, but with the end of the integral pocket 15 in partial cut-away to show the gurney cover 13 (optionally folded with side flaps 31) in an accordion folding pattern 81 folded in the integral pocket. Also shown opening into the integral pocket 39.

Figure 4:
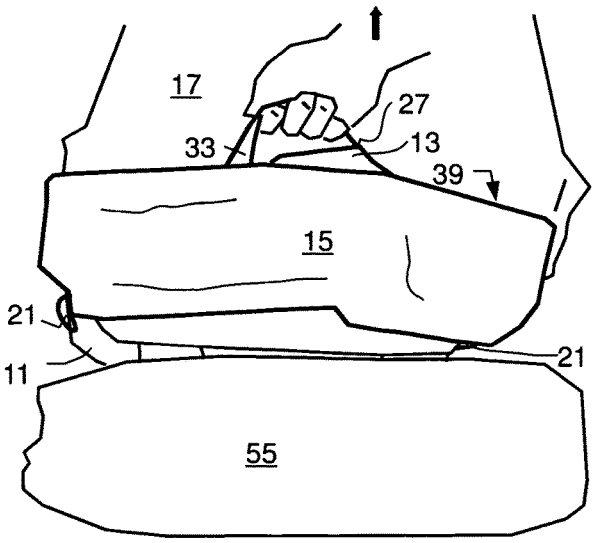
FIG. 4, FIG. 5 and FIG. 6 illustrate deployment of a gurney cover as in FIG. 1 and FIG. 2.
Figure 5:
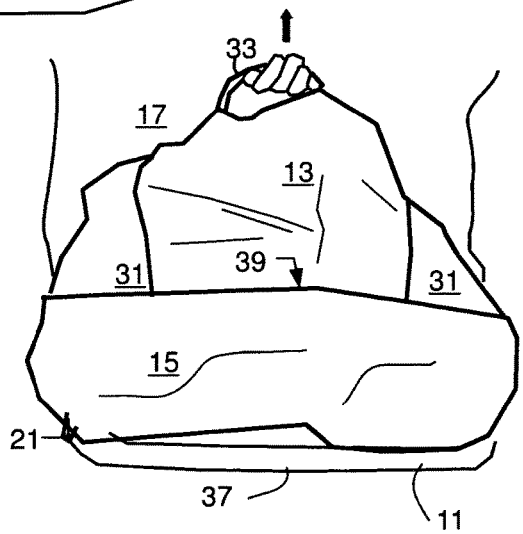
Figure 6:
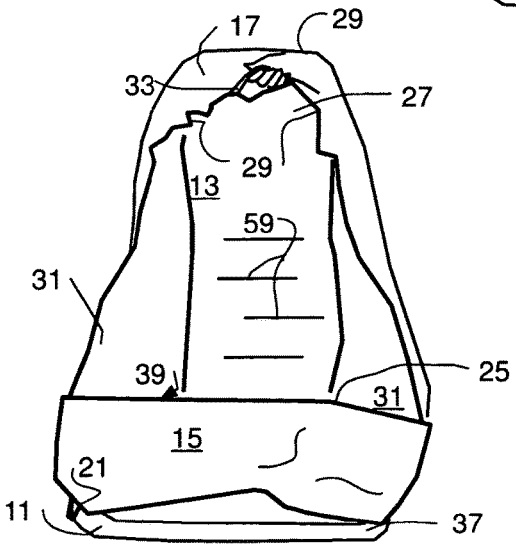

FIG. 4, FIG. 5, and FIG. 6, illustrate deployment of the cover from an undeployed condition. In FIG. 4, the opening 39 into the integral pocket 15 is opened. Attached to the free end 27 is a handle 33, or other means for grasping the end, by which the user pulls the gurney cover 13 out of integral pocket from its folded condition in the integral pocket 15. The free end 27 is pulled (see arrow) in the direction of the second end 49 of the mattress 17. For illustration purposes is shown an optional oxygen bottle 55 mounted to the gurney.

In FIG. 5 the gurney cover 13 is partially unfolded from inside the integral pocket 15, and is almost fully extended and out of the integral pocket 15 in FIG. 6. The gurney cover 13, when in the integral pocket is folded in a manner that allows easy deployment when pulled without interference or snagging. A suitable folding system involves a series transverse folds alternating up and down in a Z– or accordion-pattern. In FIG. 5 and FIG. 6, are shown spaced folding lines 59 where the cover was folded. The accordion-fold system permits an easy refolding for redeployment. Other folding systems may also be suitable.

In FIG. 6 the fitted corners 29 of the gurney cover 13 are near the second end 49 of the mattress where the gurney cover 13, using the fitted corners 29, is fitted over the end of the mattress.

Figure 7:
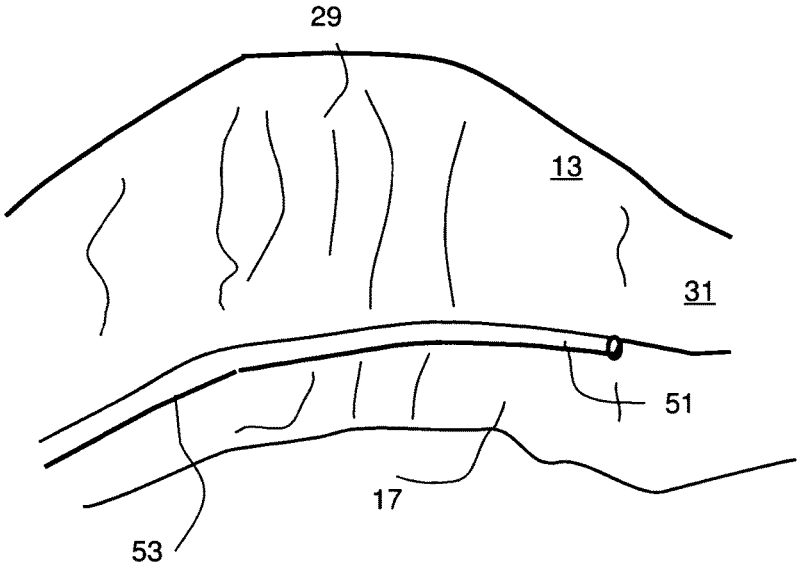
FIG. 7 shows a corner of a mattress corner at the head end of a gurney with a gurney cover secured over the corner head end of the mattress by elastic in the seam of the cover.

Referring also to FIG. 7, the showing a fitted corner 29 is shown fitted upon and over the mattress 17. The gurney cover 13 at the fitted corner has an elastic 51 sewn in to an edge 53 of the cover 13 to provide a fitted attachment similar to a fitted sheet.

Also show in FIG. 7 is a side flap 31 that, in this example, is continuous with the fitted end and provides opposition to the force of the elastic 51. The side flaps 31 can be folded over the gurney cover 13 as part of the gurney cover, and together with the gurney cover 13 accordion-folded into the integral 15 (see FIG. 3B). As shown in FIG. 1, side flaps 31 can be attached to or extend from lateral edges of the gurney cover 71. The side flaps can drop down to cover lateral edges of the mattress can extend along the length of the deployed gurney cover 13 and provide protection to the sides of the mattress 17. Side flaps are optional and construction of the elastic 51 can be easily altered without side flaps to anchor its ends.

Referring to FIG. 8, and FIG. 9, showing detail of a deployed gurney cover at attached end 25 of the gurney cover 13. FIG. 8 shows a closed opening 39 of the integral pocket 15 with the upper lip 41 of the opening is slightly raised to show loop and hook attachment strips 61, which are used to hold the opening closed. In FIG. 9, the opening in open showing the loop and hook attachment strips 61 (one is phantom). Also shown in FIG. 8, and FIG. 9, are fold lines 59 and which are stretched out accordion folds resulting from the accordion folding in the integral pocket 15. (See FIG. 3B.)

Once deployed the gurney cover can remain on the gurney as necessary, or be completely removed by pulling off the fitted end and removing the attachments of the integral pocket.

To return to the undeployed condition, the steps for deployment are essentially reversed. The side flaps are folded up over the gurney cover, and the free end with fitted corners is pulled off of the mattress. The cover is refolded into an accordion fold until the entire cover can be placed into the integral pocket. The handle is then pushed into the integral pocket and the opening of the integral pocket closed. This restoration to the undeployed condition can be accomplished while the integral pocket is attached or not attached to the gurney.

While this invention has been described with reference to certain specific embodiments and examples, it will be recognized by those skilled in the art that many variations are possible without departing from the scope and spirit of this invention, and that the invention, as described by the claims, is intended to cover all changes and modifications of the invention which do not depart from the spirit of the invention.

What is claimed is:

1. A fabric cover for a gurney with an attached gurney mattress and a patient area comprising;

a gurney cover that includes a pocket, the pocket including attachments configured for releasable attachment to a gurney near a first end of a gurney mattress, a first position with the gurney cover located within the pocket with one end of the gurney cover attached to an interior of the pocket, and handle structure at a free end of the gurney cover that is configured to enable quick traction from the pocket, and a second position with the free end of the gurney cover having been pulled by the handle structure through an opening of the pocket and extended over a patient area to a second end of a gurney mattress, the free end of the gurney cover including fitting structure for removably attaching to a second end of a gurney mattress end, at the second position.

2. A fabric cover as in claim 1 wherein the releasable attachments comprise web straps and hook and loop fasteners.

3. A fabric cover as in claim 1 wherein the gurney cover is folded in the pocket and when the gurney cover is pulled through the opening the gurney cover is unfolded and extended.

4. A fabric cover as in claim 1 wherein the handle structure is a handle.

5. A fabric cover as in claim 4 wherein the handle comprises a web strap.

6. A fabric cover as in claim 1 wherein the fitting structure comprises fitted corners at corners at the second end of the gurney cover.

7. A fabric cover as in claim 6 wherein the fitted corners comprise elastic at the edge of the gurney cover.

8. A fabric cover as in claim 1 wherein the opening of the integral pocket comprises a closure.

9. A fabric cover as in claim 8 wherein the closure comprises opposing loop and hook strips.

10. A fabric cover as in claim 1 wherein the gurney cover comprises side flaps that extend from lateral edges of the gurney cover.

11. A fabric cover for a gurney mattress comprising:

a pocket that is dimensioned to hold a gurney cover, the gurney cover attached to the pocket at an attachment end at an opening of the pocket, the pocket having attachments configured for releasable attachment near a first end of a gurney structure;

the gurney cover having a fitted extended end that when extended from the pocket releasably attaches to a second end of the gurney mattress by fitting to a second end of a gurney mattress, wherein the gurney cover has a total width that is wider than the pocket so as to define laterally extending side flaps on lateral edges of the gurney cover;

the gurney having a first position with the laterally extending side flaps folded over the gurney cover as part of the gurney cover and together with the gurney cover folded within the pocket, and a second position with the gurney cover extended from the pocket with the fitted extended end configured to be releasably attached to a second end of a gurney mattress, the laterally extending side flaps unfolded in a configuration so as to hang down sides of a gurney mattress.

12. A fabric cover for a gurney comprising;

a pocket that is dimensioned to contain a gurney cover with gurney attachments configured for releasable attachment to a gurney structure, the gurney cover having an attached end attached to the interior of the pocket, and handle structure at a free end of the gurney cover that is configured to enable quick traction of the free end of the gurney cover out of the pocket to extend the gurney cover over a length of a gurney, the free end of the gurney cover including fitting structure, such that the free end can be removably fitted to a mattress of a gurney after the free end is pulled through an opening of the pocket, and extended, wherein the gurney cover has a total width that is wider than the pocket so as to define laterally extending side flaps on lateral edges of the gurney cover, the side flaps being foldable over the cover to make the cover have a same width as the pocket when storing the cover within the pocket, and a plurality of equally spaced fold lines transverse to a length of the gurney cover that enable an accordion-style fold of the gurney cover for storage within the cover and quick traction to and from the pocket.

13. A fabric cover for a gurney as in claim 12 wherein the pocket is dimensioned to contain the gurney cover completely such that the pocket may be closed at its edges with the gurney cover contained inside the pocket completely.

14. A fabric cover for a gurney as in claim 12 wherein the gurney cover is fully contained within the pocket in a folded pattern when being stored within the pocket.

15. The fabric cover in claim 12, wherein the gurney attachments comprise web straps and hook and loop fasteners.

16. The fabric cover in claim 15, wherein at least one web strap and hook and loop fastener is located on either side of the pocket.

17. The fabric cover in claim 12, wherein the cover is made of heavy duty, washable, water repellant fabric.

* * * * *